US007887604B1

(12) United States Patent
Hicks et al.

(10) Patent No.: US 7,887,604 B1
(45) Date of Patent: Feb. 15, 2011

(54) MICROEMULSION (NANOTECHNOLOGY) FUEL ADDITIVE COMPOSITION

(75) Inventors: Richard H. Hicks, Rail Road Flat, CA (US); Ben C. Song, Palo Alto, CA (US)

(73) Assignee: H2OIL, Inc., Hayward, CA (US)

( * ) Notice: Subject to any disclaimer, the term of this patent is extended or adjusted under 35 U.S.C. 154(b) by 1579 days.

(21) Appl. No.: 11/072,124

(22) Filed: Mar. 7, 2005

Related U.S. Application Data

(63) Continuation-in-part of application No. 10/805,125, filed on Mar. 22, 2004, now abandoned, which is a continuation-in-part of application No. 10/029,438, filed on Dec. 24, 2001, now abandoned, which is a continuation-in-part of application No. 09/588,029, filed on Jun. 5, 2000, now abandoned, which is a continuation-in-part of application No. 09/039,675, filed on Mar. 16, 1998, now abandoned, which is a continuation-in-part of application No. 08/629,802, filed on Apr. 10, 1996, now abandoned, which is a continuation-in-part of application No. 08/296,457, filed on Aug. 26, 1994, now abandoned, which is a continuation-in-part of application No. 08/153,049, filed on Nov. 17, 1993, now abandoned.

(51) Int. Cl.
*C10L 1/32* (2006.01)

(52) U.S. Cl. ..... 44/301; 44/302

(58) Field of Classification Search ..... 44/301, 44/302, 451

See application file for complete search history.

(56) References Cited

U.S. PATENT DOCUMENTS 3,265,474 A * 8/1966 Siegel ..... 44/346
4,396,400 A * 8/1983 Grangette et al. ..... 44/301

FOREIGN PATENT DOCUMENTS

DE 3218294 A1 * 11/1982
GB 2106135 A * 4/1983

* cited by examiner

*Primary Examiner*—Glenn A Caldarola
*Assistant Examiner*—Taiwo Oladapo
(74) *Attorney, Agent, or Firm*—William S. Bernheim

(57) ABSTRACT

A micro-emulsion forming (nanotechnology) fuel additive composition is disclosed which improves the fuel economy and reduces the exhaust emissions of internal combustion machines when used at a cost effective dose level of about 20 to 500 ppm in the fuel.

4 Claims, No Drawings

MICROEMULSION (NANOTECHNOLOGY) FUEL ADDITIVE COMPOSITION

CROSS REFERENCES TO RELATED APPLICATIONS

This application is a continuation-in-part of U.S. patent application Ser. No. 10/805,125, filed 22 Mar., 2004 now abandoned; which is a continuation-in-part of Ser. No. 10/029,438, filed 24 Dec. 2001, now abandoned; which is a continuation-in-part of Ser. No. 09/588,029, filed 5 Jun. 2000, now abandoned; which is a continuation-in-part of Ser. No. 09/039,675, filed 16 Mar. 1998, now abandoned; which is a continuation-in-part of Ser. No. 08/629,802, filed 10 Apr. 1996, now abandoned; which is a continuation-in-part of Ser. No. 08/296,457, filed 26 Aug. 1994, now abandoned; which is a continuation-in-part of Ser. No. 08/153,049, filed 17 Nov. 1993, now abandoned.

All of the disclosures in the prior applications are incorporated herein by reference in their entirety.

BACKGROUND

1. Field of the Invention

There exists a large body of prior art patents all concerned with fuel/water emulsions being used to improve the combustion of liquid hydrocarbon fuels. Almost exclusively, these distinguish amongst themselves by patentable differences between the surfactants and co-surfactants used to create these emulsions.

It is well known that water can be used to improve the combustion of liquid hydrocarbon fuels used in internal combustion machines. Water being introduced into the combustion chamber either together with the fuel in the form of an emulsion (most common) or by injection into the combustion air stream (least common).

However, there is another pathway for water to enter the combustion chamber. Water can enter as an emulsion within the extremely small amount of engine crankcase lubricating oil which is always burned in all typical internal combustion machines.

BACKGROUND

2. Description of the Prior Art

Water and lighter hydrocarbon fuels (gasoline and diesel) do not stay mixed long enough for combustion purposes and several strategies have been employed to achieve sufficient emulsion stability. U.S. Pat. No. 6,607,566 Coleman teaches using a small quantity of emulsifying agent and significant mechanical agitation to create fuel macro-emulsions (having water droplets greater than 1.0 microns diameter). U.S. Pat. No. 3,876,391 McCoy teaches fuel micro-emulsions (having water droplets smaller than 0.1 microns diameter) using significantly more emulsifying agents and less mechanical agitation.

Prior art water levels of 10,000 to 400,000 parts per million ("ppm") in the fuel is generally accepted as necessary to achieve any worthwhile improvement in combustion.

However, in order to achieve even short term fuel emulsion stability at these "high" water levels, significantly large quantities of "expensive" emulsifying surfactants are required (typically 5,000 to 200,000 ppm). This surfactant expense always makes the cost/benefit ratio of this type of high water content fuel emulsion unsuitable for regular commercial applications. Typical of all this group of patents is U.S. Pat. No. 4,744,796 Hazbun.

U.S. Pat. No. 4,396,400 Grangette claims 1,000 ppm of emulsified water (together with 500 ppm of surfactant) gives the optimum improvement. Again, using 500 ppm of surfactant would still make this fuel too expensive for most commercial applications.

Grangette also discloses that it is possible to produce "ultra-low" water content fuel emulsions by adding 100 ppm of water, but employing only 25 ppm of a single "crude" surfactant. With so much water and so little surfactant, the resulting fuel emulsion would not be stable enough for commercial applications. Grangette failed to realize that any ultra low water content fuel emulsion (about 100 ppm added water) always requires significantly more "crude" surfactant than added water in order to remain stable over the required lifetime of the fuel (extra surfactants are required to emulsify the 50 to 100 ppm dissolved water typically present in all commercially available liquid hydrocarbon fuels). This requirement has never been recognized and used by any prior art.

SUMMARY OF THE INVENTION

Objects and Advantages

Liquid hydrocarbon fuels intended for use in internal combustion machines are dosed at 20 to 500 ppm with a micro-emulsion forming additive. The resulting fuel composition has the object of improving fuel efficiency to such an extent that the invention can be employed in a significantly cost effective manner not previously realized by any prior art fuel emulsion.

Another object of the invention is to increase engine power.

A further object is to reduce engine exhaust emissions.

Still further objects and advantages will become apparent from consideration of the following description and examples.

DETAILED DESCRIPTION OF THE INVENTION

Additive compositions are disclosed which can be mixed with liquid hydrocarbon fuels (such as gasoline, diesel fuel, and jet fuel) to form stable water-in-oil micro-emulsions.

Improved combustion and fuel efficiency can be achieved by dosing 20 to 500 ppm of the additive into hydrocarbon fuels. This results in a fuel micro-emulsion containing only about 5 to 95 ppm of added water. Long term stability of this low dose level micro-emulsion fuel (sufficient for most commercial applications) is achieved by using high surfactant to water ratios in the additive (from about 8:1 to 0.5:1, more preferably from about 3:1 to 1.5:1). Consequently, the additive usually employs significantly more surfactant than water (unlike any prior art).

Even if over time the fuel micro-emulsion breaks down, the amount of water released is not large (typically 50 ppm) and should easily be absorbed by the fuel. The expected fuel additive benefits may be lost but no damage to the engine should occur (which could lead to possible product liability claims).

Typical prior art fuel emulsions teach adding 5,000 ppm of surfactant together with 10,000 ppm water. This renders the background level of 50 to 100 ppm dissolved water in the fuel totally insignificant to prior art. However, knowledge of this dissolved water content is absolutely critical to the successful application of the present invention. It is very important not to overwhelm the small amount of surfactant added to the fuel by expecting it to emulsify too much water (resulting in an unstable macro-emulsion).

When the fuel additive dose level becomes so low that the background quantity of dissolved water in the fuel approaches (or exceeds) the quantity of water employed in the fuel additive, then it is critical to increase the surfactant to water ratio in the present additive to compensate for the extra water in the fuel. This allows for long term fuel emulsion stability (as the additive slowly emulsifies the dissolved water in the fuel).

There exists a cost/benefit threshold in emulsion fuels which cannot be crossed except by fuels dosed with less than about 500 ppm of micro-emulsion forming fuel additive. With more than about 500 ppm of additive, the process costs too much relative to the fuel savings. With less than about 20 ppm of additive, there is generally too little surfactant present for the fuel emulsion to have any long term stability.

Improved combustion and fuel efficiency can be achieved by dosing the additive into lubricating oils. All internal combustion machines inevitably burn a small amount of lubricating oil during combustion. Typically, the quantity of lubricating oil consumed would be very small; about 1 pint per 3,000 miles traveled (or about 100 ml per 1,0001 cm). It has never before been realized that such a small amount of lubricating oil could still carry sufficient quantities of a water micro-emulsion to be able to affect engine combustion characteristics in any significant manner.

The additives are produced by mixing together appropriate proportions of surfactant(s), co-surfactant(s) and water. Hydrocarbon solvents can also be included.

Generally, a minimum number of at least two surfactants would be required, each one acting against the other in order to achieve exactly the right HLB balance for the specific fuel to be treated. For a good explanation of this required surfactant HLB balance refer to U.S. Pat. No. 3,876,391 McCoy.

When the additive is mixed with liquid hydrocarbon fuels a multitude of dispersed micro-emulsified water droplets are created, each droplet having an initial diameter from about 1.0 to 100 nanometers (0.001 to 0.1 microns), typically 3.0 to 9.0 nanometers. These dispersed micro-emulsified water droplets remain in stable suspension until such time as they are carried into the combustion chamber with the fuel.

Additives of the present invention can be produced which are stable enough for most commercial applications. These severe "real world" applications require emulsion stability from below −40 deg C. to over +80 deg C., not only as an additive but also as a diluted additive (for retail sales) and more particularly after dosing into the fuel.

TABLE 1

(Commercially Available Surfactants Used to Produce the Additives):

| Trade Name | Chemical Name | Type | Supplier |
|---|---|---|---|
| Arquad T-50 | Trimethyl Tallow Alkyl Quat | Cationic | Akzo Nobel |
| Aristonate "M" | Sodium Alkyl Aryl Sulfonate | Anionic | Pilot |
| Aristonate "L" | Sodium Alkyl Aryl Sulfonate | Anionic | Pilot |
| Chembetaine CAS | Cocoamidopropyl Hydroxysultaine | Amphoteric | Chemron |
| Hamposyl C-30 | Sodium Cocyl Sarcosinate | Anionic | Hampshire |
| Makon 4 | Ethoxylated Alkylphenol | Non-ionic | Stepan |
| Makon 8 | Ethoxylated Alkylphenol | Non-ionic | Stepan |
| Norfox TLS | Triethanolamine Lauryl Sulfate | Anionic | Norman Fox |
| Ninate 411 | Amine Alkylbenzene Sulfonate | Anionic | Stepan |
| Span 80 | Sorbitan Monooleate | Non-ionic | ICI |
| Surfonic L24-4 | Linear Alcohol Ethoxylate | Non-ionic | Huntsman |

TABLE 1-continued (Commercially Available Surfactants Used to Produce the Additives):

| Trade Name | Chemical Name | Type | Supplier |
|---|---|---|---|
| Surfonic L24-9 | Linear Alcohol Ethoxylate | Non-ionic | Huntsman |
| Ninate 411 | Amine Alklybenzene Sulphonate | Non-ionic | Stepan |
| Tween 80 | POE (20) Sorbitan Monooleate | Non-ionic | ICI |
| Pamak W4 | Tall Oil Fatty Acid | Non-ionic | Hercules |
| Norfox IM 38 | Oleyl Imidazoline Hydro-chloride | Cationic | Norman Fox |
| Norfox F-221 | Oleamide Diethanolamine | Non-ionic | Norman Fox |

Comments on Co-Surfactants Used in the Additives

All co-surfactants used to produce the additives should be well recognized by those skilled in the art and are readily available from many industrial sources. For this reason, trade names and suppliers have been omitted for these components.

Although specific alcohols have been named as being suitable co-surfactants, other low molecular weight alcohols (either alone or in combination) could also be used.

Although specific glycols have been named as being suitable co-surfactants, other low molecular weight glycols (either alone or in combination) could also be used.

Also, certain glycol ethers have been employed in combination with low molecular weight alcohols to form strong coupling agents well known to those skilled in the art. Specifically, these glycol ethers can be obtained from Dow Chemical under the trade names Dowanol DPM (dipropylene glycol methyl ether) and Dowanol EB (ethylene glycol n-butyl ether). Although these two glycol ethers have been specifically named as being suitable co-surfactants, other glycol ethers might also be suitable.

Comments on Hydrocarbon Solvents Used in the Additives

Although kerosene was used as the hydrocarbon (HC) solvent when making certain of the additives, those skilled in the art will realize that other hydrocarbon solvents (including oxygenated hydrocarbons) could easily be used instead of kerosene. Specifically, aliphatic, aromatic or paraffinic hydrocarbons (either alone or in combination) could also be used.

Producing the additives (Examples #1 to #20)

When mixing together the surfactant(s), co-surfactant(s), water and hydrocarbon (HC) solvent to produce the micro-emulsion forming additives used in these examples, the following technique was used:

1) For those additives containing a hydrocarbon solvent, this was the first ingredient.

2) Alternatively, the co-surfactant(s) was either the next or the first ingredient.

3) Then the surfactant(s) was added using gentle stirring.

4) Finally, the water was added slowly with gentle stirring until the resulting additive was clear and stable. Regular city water (not distilled water) was used in all examples.

5) All ratios, ppm's and percentages used herein and elsewhere are by weight.

EXAMPLES OF THE INVENTION

Additives #1 to #12

All additives disclosed in the following examples (#1 to #12) deliberately use various combinations of already existing and commercially available surfactants and co-surfactants. This has been done to clearly demonstrate that these additives should not be limited to any particular combination of specific surfactant(s) and co-surfactant(s). Each of the examples (#1 to #12) employs a high surfactant to water ratio (up to 8:1) necessary for long term emulsion stability.

There must be many such additives possible (using different combinations of other surfactants and co-surfactants) that could also be used to produce similar micro-emulsion forming additives. Reference is made specifically to (U.S. Pat. No. 4,744,796 Hazbun) which clearly demonstrates that various (equally effective) micro-emulsion fuels can be produced using diversely different types of surfactant and co-surfactant combinations.

These other combinations might be better (or worse) than the specific examples which follow.

Some may have better high (or low) temperature stability, or have improved pour point, flash point, cost, viscosity, corrosiveness, commercial availability, toxicity, freezing point, color, smell, legislative acceptability, or any number of other particular benefits depending on the balance of importance prevailing at the time.

Therefore, it is not critical which specific surfactant or co-surfactant combinations are used, provided that they are adequate. Different combinations may be better than others in some way or another, but it is essentially the use of a cost effective micro-emulsion forming additive (employing a high surfactant to water ratio) which is crucial to the practical application of the present invention.

TABLE 2

(Component Percentage Composition for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| HC Solvent (Kerosene) | — | — | — | — | — | — | 20 | 30 | — | 20 | 20 | — |
| Arquat T-50 | — | — | — | — | — | — | — | — | — | — | — | 20 |
| Aristonate "M" | — | 35 | — | — | — | — | — | — | — | — | — | — |
| Aristonate "L" . . . | — | 25 | — | — | — | — | — | — | — | — | — | — |

TABLE 2-continued (Component Percentage Composition for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| Chembetaine CAS | — | — | — | — | — | — | — | — | — | — | 10 | — |
| Hamposyl C-30 | — | — | — | — | 4 | — | — | — | — | — | — | — |
| Makon 4 | — | — | — | — | — | 20 | — | 20 | — | 30 | — | — |
| Makon 8 | — | — | — | 25 | — | 10 | — | 10 | — | 30 | — | — |
| Norfox TLS | — | — | — | — | — | — | 7 | — | — | — | — | — |
| Ninate 411 70 | — | — | — | — | — | 30 | — | 30 | 30 | — | 60 | — |
| Span 80 | — | — | — | 55 | 66 | — | 53 | — | 50 | — | — | 50 |
| Surfonic L24-4 | — | — | 40 | — | — | — | — | — | — | — | — | — |
| Surfonic L24-9 | — | — | 40 | — | — | — | — | — | — | — | — | — |
| Methanol | — | — | 10 | — | — | — | — | — | 5 | — | — | — |
| Ethanol | — | — | — | 10 | 10 | — | — | — | — | — | — | — |
| Iso-Propanol | 20 | — | — | — | — | 20 | 10 | — | — | — | — | 20 |
| 2-Butanol | — | 20 | — | — | 10 | — | — | — | — | — | — | — |
| Ethylene Glycol | — | — | — | — | — | — | — | — | — | 10 | — | — |
| Propylene Glycol | — | — | — | — | — | — | — | — | 5 | — | — | — |
| Water | 10 | 20 | 10 | 10 | 10 | 20 | 10 | 10 | 10 | 10 | 10 | 10 |
| Total (%) | 100 | 100 | 100 | 100 | 100 | 100 | 100 | 100 | 100 | 100 | 100 | 100 |

TABLE 3

(Analysis of Component Percentage for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| HC Solvent (Kerosene) | — | — | — | — | — | — | 20 | 30 | — | 20 | 20 | — |
| Surfactant(s) | 70 | 60 | 80 | 80 | 70 | 60 | 60 | 60 | 80 | 60 | 70 | 70 |
| Co-surfactant(s) | 20 | 20 | 10 | 10 | 20 | 20 | 10 | 0 | 10 | 10 | 0 | 20 |
| Water | 10 | 20 | 10 | 10 | 10 | 20 | 10 | 10 | 10 | 10 | 10 | 10 |
| Total (%) | 100 | 100 | 100 | 100 | 100 | 100 | 100 | 100 | 100 | 100 | 100 | 100 |

TABLE 4

(Additive Dose Ratio and Component ppm's in Fuel for Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| Hydrocarbon fuel | Gas | #2D | Gas | #2D | Gas | Gas | Gas | Gas | #2D | Gas | #2D | Gas |
| Dose Ratio | 2K | 4K | 2K | 2K | 2K | 4K | 2K | 2K | 2K | 2K | 2K | 2K |
| Kerosene | 0 | 0 | 0 | 0 | 0 | 0 | 100 | 150 | 0 | 100 | 100 | 0 |
| Surfactant(s) | 350 | 150 | 400 | 400 | 350 | 150 | 300 | 300 | 400 | 300 | 350 | 350 |
| Co-surfactant(s) | 100 | 50 | 50 | 50 | 100 | 50 | 50 | 0 | 50 | 50 | 0 | 100 |
| Water | 50 | 50 | 50 | 50 | 50 | 50 | 50 | 50 | 50 | 50 | 50 | 50 |
| Total ppm in fuel | 500 | 250 | 500 | 500 | 500 | 250 | 500 | 500 | 500 | 500 | 500 | 500 |
| Treat cost/gal | 55 | 17 | 51 | 95 | 99 | 25 | 89 | 52 | 88 | 42 | 56 | 100 |

Note: (a) Dose ratio 2K=2,000:1 and 4K=4,000:1.

(b) Dose ratio used was based on the relative emulsifying ability of the particular additive surfactant/co-surfactant combination. Some additives were much stronger than others, and could be used at a lower dose rate.

(c) For comparison purposes, relative treatment cost/gallon are all compared to example #12 (the most expensive) being given the arbitrary value of 100.

TABLE 5

(Analysis of Component ppm's in Fuel for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| HC Solvent | 0 | 0 | 0 | 0 | 0 | 0 | 100 | 150 | 0 | 100 | 100 | 0 |
| Surfactant(s) | 350 | 150 | 400 | 400 | 350 | 150 | 300 | 300 | 400 | 300 | 350 | 350 |
| Co-surfactant(s) | 100 | 50 | 50 | 50 | 100 | 50 | 50 | 0 | 50 | 50 | 0 | 100 |
| Water | 50 | 50 | 50 | 50 | 50 | 50 | 50 | 50 | 50 | 50 | 50 | 50 |
| Additive in Fuel: | 500 | 250 | 500 | 500 | 500 | 250 | 500 | 500 | 500 | 500 | 500 | 500 |
| Hydrocarbon Fuel: | - - - Balance up to 100% (1,000,000 ppm) - - - | | | | | | | | | | | |
| Surf/Water Ratio | 7:1 | 3:1 | 8:1 | 8:1 | 7:1 | 3:1 | 6:1 | 6:1 | 8:1 | 6:1 | 7:1 | 7:1 |

FURTHER EXAMPLES OF THE INVENTION

Additives #13 to #20

In previous examples #1 to #12 only one or two surfactant(s) have been used in combination, consequently forming relatively "crude" additives. Those skilled in the art of surfactant chemistry should easily be able to improve the efficiency of the surfactant(s) and co-surfactant(s) combination. These more "sophisticated" additives would require less surfactant per unit of water and hence significantly improve the overall cost effectiveness of the additive.

Examples #1 to #12 require surfactant to water ratios of typically 7:1 in order to produce sufficiently stable emulsions. However, when using these more "sophisticated" surfactant packages, this ratio could be reduced to 3:1 or less (sometimes much less).

Therefore, examples #13 to #20 which follow are used to clearly demonstrate how these more "sophisticated" chemical packages can significantly reduce the total quantities of surfactants required, and hence improve the cost effectiveness of the additive, while still remaining sufficiently stable for most commercial applications.

TABLE 6

(Component Percentage Composition for Additive Examples #13 to #20):

| | #13 | #14 | #15 | #16 | #17 | #18 | #19 | #20 |
|---|---|---|---|---|---|---|---|---|
| Hydrocarbon Solvent (Kerosene) | — | — | — | 16.7 | — | — | — | — |
| Amine alkylbenzene sulphonate | 21.3 | 21.3 | 21.3 | 26.7 | 21.2 | 21.4 | 27.4 | 22.2 |
| POE (20) sorbitan monoleate | 10.4 | 10.4 | 10.4 | 3.3 | 7.7 | 12.9 | 16.5 | 2.2 |
| Tall oil fatty acids | 9.2 | 9.2 | 9.2 | 6.6 | 15.3 | 5.3 | 6.8 | — |
| Oleyl imidazoline hydrochloride | 4.8 | 4.8 | 4.8 | — | — | 6.4 | 8.2 | — |
| Oleamide diethanolamine | 8.0 | 8.0 | 8.0 | 13.3 | 7.7 | 10.7 | 13.6 | 4.5 |
| Methanol | 18.0 | 18.0 | 18.0 | — | — | 16.1 | 20.6 | — |
| Iso-propanol | — | — | — | 16.7 | 14.3 | — | — | — |
| N-butanol | — | — | — | — | — | — | — | 11.6 |
| Ethylene glycol n-butyl ether | 3.2 | 3.2 | 3.2 | — | — | 4.3 | 5.5 | — |
| Dipropylene glycol methyl ether | 0.7 | 0.7 | 0.7 | — | — | 1.1 | 1.4 | 2.3 |
| Water | 24.4 | 24.4 | 24.4 | 16.7 | 33.8 | 21.8 | 00.0 | 57.2 |
| Total (%) | 100 | 100 | 100 | 100 | 100 | 100 | 100 | 100 |

TABLE 7

(Analysis of Component Percentages for Additive Examples #13 to #20):

| | #13 | #14 | #15 | #16 | #17 | #18 | #19 | #20 |
|---|---|---|---|---|---|---|---|---|
| Hydrocarbon Solvent | 0 | 0 | 0 | 16.7 | 0 | 0 | 0 | 0 |
| Surfactant(s) | 53.7 | 53.7 | 53.7 | 49.9 | 51.9 | 56.7 | 72.5 | 28.9 |
| Co-surfactant(s) | 21.9 | 21.9 | 21.9 | 16.7 | 14.3 | 21.5 | 27.5 | 13.9 |
| Water | 24.4 | 24.4 | 24.4 | 16.7 | 33.8 | 21.8 | 00.0 | 57.2 |
| Total (%) | 100 | 100 | 100 | 100 | 100 | 100 | 100 | 100 |

TABLE 8

(Dose Ratio and Component ppm's in the Fuel for Examples #13 to #20):

| | #13 | #14 | #15 | #16 | #17 | #18 | #19 | #20 |
|---|---|---|---|---|---|---|---|---|
| Hydrocarbon Fuel | Gas | Gas | Gas | Gas | Gas | #2D | #2D | Gas |
| Additive Dose Ratio | 7.5K | 12K | 50K | 4K | 4K | 10K | 10K | 6K |
| Kerosene | 0 | 0 | 0 | 42 | 0 | 0 | 0 | 0 |
| Surfactant(s) | 72 | 45 | 11 | 124 | 130 | 57 | 72 | 48 |
| Co-surfactant(s) | 29 | 18 | 4 | 42 | 35 | 21 | 28 | 23 |
| Water | 32 | 20 | 5.0 | 42 | 85 | 22 | 0.0 | 95 |
| Total ppm in fuel | 133 | 83 | 20 | 250 | 250 | 100 | 100 | 166 |
| Treatment cost/gal | 11 | 7 | 2 | 23 | 18 | 9 | 11 | 7 |

TABLE 9

(Analysis of Component ppm's in the Fuel for Examples #13 to #20):

| | #13 | #14 | #15 | #16 | #17 | #18 | #19 | #20 |
|---|---|---|---|---|---|---|---|---|
| Hydrocarbon Solvent | 0 | 0 | 0 | 42 | 0 | 0 | 0 | 0 |
| Surfactant(s) | 72 | 45 | 11 | 124 | 130 | 57 | 72 | 48 |
| Co-surfactant(s) | 29 | 18 | 4 | 42 | 35 | 21 | 28 | 23 |
| Water | 32 | 20 | 5.0 | 42 | 85 | 22 | 0.0 | 95 |
| Total Additive in fuel: | 133 | 83 | 20 | 250 | 250 | 100 | 100 | 166 |
| Hydrocarbon Fuel: | - - - Balance up to 100% (1,000,000 ppm) - - - | | | | | | | |
| Surfactant/ Water Ratio | 2.2:1 | 2.2:1 | 2.2:1 | 3:1 | 1.5:1 | 2.6:1 | N/A | 0.5:1 |

TABLE 10

(Component Ratios and Percentages for Additive Examples #1 to #20):

| Liquid | Ratio (Preferred) | Ratio (Range) |
|---|---|---|
| Surfactant(s) | 3.0 to 1.5 | 8.0 to 0.5 |
| Co-surfactant(s) | 1.0 to 0.4 | 2.0 to 0.0 |
| Water ( =1.0) | 1.0 | 1.0 |
| **Liquid** | **% (Preferred)** | **% (Range)** |
| Surfactant(s) | 49.9 to 72.5 | 28.9 to 80.0 |
| Co-surfactant(s) | 13.9 to 21.9 | 0.0 to 27.5 |
| Water | 16.7 to 33.8 | 10.0 to 57.2 |

TABLE 11

(Additive ppm's in Fuel for Examples #1 to #20):

| Liquid | ppm in fuel (Preferred) | ppm in fuel (Range) |
|---|---|---|
| Surfactant(s) | 48 to 130 | 11 to 400 |
| Co-surfactant(s) | 21 to 42 | 0 to 100 |
| Water | 20 to 85 | 5 to 95 |

Vehicle Test Results (Using Fuels Dosed with Additive Examples #1 to #20)

In examples #1 to #20 fuels dosed with ultra low treat rate micro-emulsion fuel additives were tested to look for benefits similar to those claimed in the "high" water content emulsion fuel prior art (typically reduced engine exhaust emissions).

No laboratory engine testing was carried out. Actual vehicles were used in "over the road" testing. Seven completely different test vehicles were used. Three were gasoline powered and four were diesel powered. Two were from USA, three from Europe, and two from Japan. Ages, mileages and emission control technologies were also widely different.

TABLE 12

(Emission % Reduction and Mileage % Increase Using Additives #1 to #20)

| Additive # | HC | CO | NOx | PM | MPG | Relative Cost |
|---|---|---|---|---|---|---|
| 1 | 20 | — | — | — | 10 | 55 |
| 2 | — | — | 5 | 15 | 6 | 17 |
| 3 | 60 | — | — | — | 10 | 51 |
| 4 | — | — | 3 | 6 | — | 95 |
| 5 | 6 | — | — | — | 4 | 99 |
| 6 | 50 | — | — | — | 10 | 25 |

TABLE 12-continued (Emission % Reduction and Mileage % Increase Using Additives #1 to #20)

| Additive # | HC | CO | NOx | PM | MPG | Relative Cost |
|---|---|---|---|---|---|---|
| 7 | 90 | — | — | — | 2 | 89 |
| 8 | 45 | — | — | — | 5 | 52 |
| 9 | — | — | 6 | 23 | 2 | 88 |
| 10 | 40 | — | — | — | 10 | 42 |
| 11 | — | — | 5 | 18 | 6 | 56 |
| 12 | 50 | — | — | — | 10 | 100 |
| 13 | 13 | 10 | 36 | — | — | 11 |
| 14 | 80 | — | — | — | 10 | 7 |
| 15 | 50 | — | — | — | 2.5 | 2 |
| 16 | 52 | 85 | 1 | — | 12 | 23 |
| 17 | 98 | +35 | 95 | — | — | 18 |
| 18 | 49 | — | 9 | 22 | 14 | 9 |
| 19 | — | — | 5 | 15 | — | 11 |
| 20 | 90 | — | — | — | 10 | 7 |

For exact details of the testing protocols used, including additive formulations, test vehicle details, testing equipment employed and specific results obtained, refer to patent application Ser. No. 10/029,438 dated 24 Dec., 2001 (now abandoned, but incorporated herein for reference purposes).

Comments on Fuel Additive Testing (Examples #1 to #20)

It is obvious from the test results that some additives are much better than others in the critical ratio of performance to cost per gallon treated. It is this ratio that determines to a large extent the commercial acceptability of any given additive.

When comparing examples #1 to #20, clearly #18 would be the "best" diesel fuel additive and #20 would be the "best" gasoline additive (based simply on the cost/benefit ratio). However, this is seriously overly simplistic. When deciding whether one additive would be "better" than another, other factors must be considered. For example, additive #18 would probably be illegal in the USA because one of the surfactants contains chlorine.

With regard to the "best" co-surfactant to use, butanol usually gives the strongest emulsions because of its solubility compromise between water and hydrocarbon. However, for a commercially acceptable fuel additive, other factors such as flash point and freeze suppression must also be considered.

The unusual, surprising and unexpected results obtained when using fuel additives of the present invention is the significant improvement in fuel economy (coupled with reduction in exhaust emissions) which allows the invention to be employed in a cost effective manner not realized by any prior art fuel emulsions.

SUMMARY OF THE INVENTION

This invention relates to a micro-emulsion fuel additive composition which reduces the exhaust emissions and improves the fuel economy of internal combustion machines in a significantly cost effective manner not realized by any prior art emulsion.

The fuel additive composition is intended to be used at a dose level of from about 20 to about 500 ppm in a liquid hydrocarbon fuel (selected from the group consisting of gasoline, diesel fuel and jet fuel) combusted in internal combustion machines.

The additive should comprise, in admixture form: from about 10% to 57.2% (preferably 16.7% to 33.8%) of water; from about 28.9% to 80% (preferably 49.9% to 72.5%) of surfactant selected from the group consisting of non-ionic, anionic, cationic and amphoteric surfactants and combinations thereof (preferably a combination of amine alkylbenzene sulphonate, POE [20] sorbitan monooleate, tall oil fatty acids, oleyl imidazoline hydrochloride and oleamide diethanolamine); from about 0% to 27.5% (preferably 13.9% to 21.9%) of co-surfactant selected from the group consisting of low molecular weight alcohols, low molecular weight glycols and glycol ethers and combinations thereof (preferably methanol, ethanol, propanol, butanol, ethylene glycol, propylene glycol, ethylene glycol n-butyl ether and dipropylene glycol methyl ether and combinations thereof); and from about 0 to about 30% (preferably 0%) of hydrocarbon solvent (preferably kerosene).

When the additive is used in a liquid hydrocarbon fuel at a dose level from about 20 to 500 ppm (preferably 83 to 250 ppm), this results in a micro-emulsion fuel composition comprising: from about 999,500 to 999,980 ppm (preferably 999, 750 to 999, 917 ppm) of hydrocarbon fuel (selected from the group consisting of gasoline, diesel fuel, and jet fuel); from about 11 to 400 ppm (preferably 48 to 130 ppm) of surfactant selected from the group consisting of non-ionic, anionic, cationic and amphoteric surfactants and combinations thereof (preferably a combination of amine alkylbenzene sulphonate, POE [20] sorbitan monooleate, tall oil fatty acids, oleyl imidazoline hydrochloride and oleamide diethanolamine); from about 0 to 100 ppm (preferably 21 to 42 ppm) of co-surfactant selected from the group consisting of low molecular weight alcohols, low molecular weight glycols and glycol ethers and combinations thereof (preferably methanol, ethanol, propanol, butanol, ethylene glycol, propylene glycol, ethylene glycol n-butyl ether and dipropylene glycol methyl ether and combinations thereof); from about 0 to 150 ppm (preferably 0 ppm) of hydrocarbon solvent (preferably kerosene); and from about 5 to 95 ppm (preferably 20 to 85 ppm) of added water, such that the ratio of surfactant to added water falls within the range from about 8:1 to about 0.5:1 (preferably about 3:1 to 1.5:1).

SCOPE OF THE INVENTION

It is to be understood that the reactants and components referred to by chemical name anywhere in the specification or claims hereof, whether referred to in the singular or plural, are identified as they exist prior to coming into contact with other substances referred to by chemical name or chemical type.

It does not matter what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure.

Thus the reactants and components are identified as ingredients to be brought together either in performing a desired chemical reaction (such as the formation of a surfactant compound) or in forming a desired composition (such as a fuel additive concentrate or additized fuel.

It will also be recognized that the additive components can be added or blended into or with the fuel individually per se and/or as components used in forming preformed additive combinations and/or sub-combinations.

Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure.

The fact that the substance, components or ingredient may have lost its original identity through a chemical reaction or transformation during the course of such blending or mixing operations is thus wholly immaterial for an accurate understanding and appreciation of this disclosure and the claims thereof.

While only a few embodiments of the invention have been shown and described herein, it will become apparent to those skilled in the art that various modifications and changes can be made in the present invention to the present fuel additive compositions to produce fuel micro-emulsions without departing from the spirit and scope of the present invention. All such modifications and changes coming within the scope of the appended claims are intended to be carried out thereby.

We claim:

1. A method to improve the fuel economy of a combustion machine, comprising:

1) producing a fuel additive composition, comprising in admixture form:
   a) a surfactant selected from the group consisting of non-ionic, anionic, cationic, amphoteric and mixtures thereof;
   b) optionally, a co-surfactant selected from the group consisting of methanol, ethanol, propanol, butanol, ethylene glycol, propylene glycol, ethylene glycol n-butyl ether, dipropylene glycol methyl ether and mixtures thereof;
   c) optionally, kerosene; and
   d) water,
2) providing a liquid hydrocarbon fuel,
3) producing a fuel composition by dosing said liquid hydrocarbon fuel with from about 20 to about 500 ppm by weight of said fuel additive such that said fuel composition comprises:
   a) from about 11 to about 400 ppm by weight of said surfactant;
   b) from about 0 to about 100 ppm by weight of said co-surfactant;
   c) from about 0 to about 150 ppm by weight of said kerosene; and
   d) from about 5 to about 95 ppm by weight of said water, such that; the weight ratio of said surfactant to said water is from about 8:1 to about 0.5:1, and
4) operating said combustion machine using said fuel composition.

2. The method of claim 1 wherein said liquid hydrocarbon fuel is selected from the group consisting of gasoline, diesel and jet fuel.

3. A method to reduce the exhaust emissions from a combustion machine, comprising:

1) producing a fuel additive composition, comprising in admixture form:
   a) a surfactant selected from the group consisting of non-ionic, anionic, cationic, amphoteric and mixtures thereof;
   b) optionally, a co-surfactant selected from the group consisting of methanol, ethanol, propanol, butanol, ethylene glycol, propylene glycol, ethylene glycol n-butyl ether, dipropylene glycol methyl ether and mixtures thereof;
   c) optionally, kerosene; and
   d) water,
2) providing a liquid hydrocarbon fuel,
3) producing a fuel composition by dosing said liquid hydrocarbon fuel with from about 20 to about 500 ppm by weight of said fuel additive such that said fuel composition comprises:

a) from about 11 to about 400 ppm by weight of said surfactant;

b) from about 0 to about 100 ppm by weight of said co-surfactant;

c) from about 0 to about 150 ppm by weight of said kerosene; and d) from about 5 to about 95 ppm by weight of said water, such that the weight ratio of said surfactant to said water is from about 8:1 to about 0.5:1, and 4) operating said combustion machine using said fuel composition.

4. The method of claim 3 wherein said liquid hydrocarbon fuel is selected from the group consisting of gasoline, diesel and jet fuel.

* * * * *